US010267460B2

(12) United States Patent
Wu et al.

(10) Patent No.: US 10,267,460 B2
(45) Date of Patent: Apr. 23, 2019

(54) LIGHT EMITTING DEVICE

(71) Applicant: XIAMEN ECO LIGHTING CO. LTD., Xiamen (CN)

(72) Inventors: Minghao Wu, Xiamen (CN); Hongkui Jiang, Xiamen (CN); Hongbin Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/435,290

(22) Filed: Feb. 16, 2017

(65) Prior Publication Data

US 2018/0112832 A1 Apr. 26, 2018

(51) Int. Cl.

| | |
|---|---|
| ***F21S 9/02*** | (2006.01) |
| ***F21V 3/02*** | (2006.01) |
| ***F21V 3/04*** | (2018.01) |
| ***F21V 3/06*** | (2018.01) |
| ***F21K 9/232*** | (2016.01) |
| ***F21K 9/235*** | (2016.01) |
| ***F21K 9/237*** | (2016.01) |
| ***F21K 9/238*** | (2016.01) |
| ***F21V 23/00*** | (2015.01) |
| ***F21V 23/06*** | (2006.01) |
| ***F21Y 115/10*** | (2016.01) |

(52) U.S. Cl.

CPC ..... *F21K 9/237* (2016.08); *F21K 9/232* (2016.08); *F21K 9/235* (2016.08); *F21K 9/238* (2016.08); *F21V 23/003* (2013.01); *F21V 23/06* (2013.01); *F21S 9/02* (2013.01); *F21V 3/02* (2013.01); *F21V 3/049* (2013.01); *F21V 3/061* (2018.02); *F21V 3/062* (2018.02); *F21Y 2115/10* (2016.08)

(58) Field of Classification Search

None

See application file for complete search history.

(56) References Cited

U.S. PATENT DOCUMENTS

| | | | | |
|---|---|---|---|---|
| 4,208,603 | A * | 6/1980 | Graves | H01J 61/96 313/1 |
| 8,911,119 | B1 * | 12/2014 | Colby | F21V 23/04 362/188 |
| 2004/0008525 | A1 * | 1/2004 | Shibata | F21K 9/232 313/271 |
| 2012/0162965 | A1 * | 6/2012 | Takeuchi | F21V 9/30 362/84 |

(Continued)

*Primary Examiner* — Britt D Hanley

(74) *Attorney, Agent, or Firm* — Chun-Ming Shih

(57) ABSTRACT

A lighting device includes translucent shell, bottom base, lamp base, light bar module, two or more metal support bars and two metal conducting bars. The bottom base connected with the translucent shell and formed a receiving space together. The lamp base set on the bottom base and equipped with a table-board. The light bar module is formed by connecting two or more light bars in series, between said two or more light bars, there are two supporting points, and s the light bar module has two electrical connection points. The metal support bars are connected to the one support point, respectively; the metal conducting bars are connected to the two electrical connection points of the light bar module, respectively, wherein the metal support bar, the light bar and the metal conducting bar constituted a side component of two substantial triangular frame structures.

17 Claims, 9 Drawing Sheets

(56) References Cited

U.S. PATENT DOCUMENTS

2012/0217862 A1* 8/2012 Matsuda ..... F21K 9/232 313/46
2012/0256538 A1* 10/2012 Takeuchi ..... F21K 9/232 313/512
2013/0049031 A1* 2/2013 Matsuda ..... H01L 33/486 257/88
2013/0141892 A1* 6/2013 Okazaki ..... F21V 3/00 362/84
2013/0155683 A1* 6/2013 Matsuda ..... F21V 15/01 362/249.02
2013/0215625 A1* 8/2013 Takeuchi ..... F21V 23/001 362/363
2013/0271989 A1* 10/2013 Hussell ..... F21V 29/004 362/249.02
2014/0313713 A1* 10/2014 Andrews ..... F21S 4/001 362/235
2014/0375201 A1* 12/2014 Su ..... F21V 29/004 313/35
2015/0003039 A1* 1/2015 Liu ..... F21K 9/00 362/84
2015/0036341 A1* 2/2015 Ge ..... F21V 3/061 362/240
2015/0069442 A1* 3/2015 Liu ..... H01L 33/504 257/98
2015/0070871 A1* 3/2015 Chen ..... H01L 24/24 362/84
2015/0255440 A1* 9/2015 Hsieh ..... H01L 25/13 257/88
2017/0205031 A1* 7/2017 Xiang ..... F21K 9/237
2018/0100625 A1* 4/2018 Fan ..... F21V 3/061

* cited by examiner

LIGHT EMITTING DEVICE

FIELD OF INVENTION

The present disclosure relates to a light emitting device, and more particularly to a light emitting device of light emitted diode.

BACKGROUND OF INVENTION

With the continuous progress of light emitting diode technology, more and more products using the characteristics of light emitted diodes are designed. In addition to replacing the lamp in the past, a variety of light bulbs have also been developed.

Light emitted diode referred to as LED. And is made of a compound containing gallium (Ga), arsenic (As), phosphorus (P), nitrogen (N), or the like. When the electrons recombine with the holes, visible light will be emitted, thus it can be used to make light emitted diodes. It can be used as an indicator, or displayed as words or numbers in the circuit and instruments. Gallium arsenide diode emits red light, gallium phosphide diode emits green light, silicon carbide diode emits yellow light, gallium nitride diode emits blue light. Because of its chemical properties, it also can be divided into organic light emitted diode (OLED) and inorganic light emitted diode (LED).

Lighting is an important part of human life, although the LED technology itself is quite mature, people still hope to design more lighting products to improve the quality of life. In order to achieve a variety of product designs, including cooling, power connection, driver, and even manufacturing cost, complexity, there are a wide range of technical issues to be resolved.

SUMMARY OF THE INVENTION

The first embodiment of the instant disclosure provides a lighting device, comprising translucent shell, bottom base, lamp base, light bar module and metal support bar. The translucent shell may be fully translucent, or partially translucent. For example, the translucent shell could be made of a translucent material such as glass, plastic material, etc., and may be further atomized or patterned on the surface in whole or in part.

The bottom base is connected with the translucent shell to form a receiving space together. For example, when the lighting device is a light bulb, the bottom base is a bulb head, and two conductive terminals are provided in side and bottom for connecting to an external power source. In another embodiment, a removable or rechargeable battery is provided in the inner space. If the external power supply is directly connected, a driving circuit may be provided for converting the general indoor power to a voltage suitable for driving the light emitted diode.

The lamp base set on said bottom base, with a table-board, and said lamp base is arranged in said receiving space. The light bar module is formed by connecting two or more light bars in series, said two or more light bars have two supporting points, and the light bar module has two electrical connection points. Taking light emitted diode bulb as an example, a number of light emitted diode chips can be packaged in series into a light bar. And then the light bars can be further connected in series or in parallel. For a chip of light emitted diode, a positive voltage terminal and a negative voltage terminal are required. They can be connected to the voltage supply point of the drive circuit to drive the chip of light emitted diode to emit light.

Two or more metal support bars extend upwardly from said table-board of said lamp base and connect to said one support point, respectively. The upward direction mentioned here refers to a variety of directions extending away from the lamp base and towards the translucent shell.

In addition, two metal conducting bars extend upwardly from the lamp base and connect to two electrical connection points of the light bar module, respectively. Wherein said metal support bar, said light bar and said metal conducting bar form two substantial triangular frame structures. The triangular frame structure mentioned above does not need to be a geometrical triangle. As long as the whole structure similar to a triangle, substantially, all can belong to said substantial triangle frame structure. And, said metal support bar, said light bar and said metal conducting bar may respectively play a part or all sides of the triangular frame structure under different designs. Some available combination ways will be illustrated with some additional graphics as follows. In further designs, said substantial triangular frame structure is composed of polygons. The polygon includes three long sides, forming a triangular-like shape substantially. Needless to say, the present invention is not limited to these examples, as long as the combination ways can achieve a substantially similar effect, all should be considered to be within the scope of the present invention.

In a design, the lamp base also has a certain degree of transparency. For example, the lamp base could be made of glass. And the translucent shell also could be made of glass. When both the lamp base and the translucent shell are made of glass, it is possible to carry out the blow molding of the glass by using a conventional bulb manufacturing process, and to perform various predetermined shapes such as bulb type, water drop type, candle type, flat-head type, or all kinds of predetermined shapes.

A pipe may be left in the blown manufacturing process, it can be used to fill the cooling gas. The method of operation in practice includes placing the lamp in a vacuum environment and then pouring various cooling gases. In some embodiments, when the power of the light emitted diode is small, the cooling gas may not be completely filled but maintain the proportion of air at, for example, 3% or more. It not only can produce a certain adjustment to the light emitting effect, but also reduce the manufacturing process's requirements and cost.

In some embodiments, said table-board of said lamp base substantially kept flat, no raised configuration. This does not mean that a certain flat is necessary, but no substantially apparent raised structure. The support of light bar is mainly achieved by the metal support bar.

In some embodiments, the height of said table-board of said lamp base is lower than the bottom position of said light bar in said light bar module.

In some embodiments, said metal support bar connects and supports said light bar module through a fastening structure at said support point. For example, there are a certain bending, buckles, springs, hooks, grooves or bumps at the support point of the metal support bar or light bar, therefor the complicated welding process can be omitted. Or even the welding process is needed, it can further enhance the stability of the structure.

In some embodiments, the appearance characteristics of said metal support bar are substantially same as said metal conducting bar.

In some embodiments, said metal support bar and said light bar module constitute an assembly unit and form a predetermined shape, and then mounted to said lamp base in the manner of said assembly unit. In this way, the complexity of assembling can be reduced to a certain extent.

In some embodiments, the rigidity of said metal conducting bar can maintain it at a fixed shape. In some embodiments, said metal support bar has a groove paralleled to the direction of said metal support bar extending from said lamp base. For example, said metal support bar is elongated and folded at a certain angle along the direction of extension to achieve greater rigidity with less material. In some embodiments, said metal support bar is nickel plated.

Another embodiment of the instant disclosure provides a lighting device, comprising light bulb shell; light bulb module, composed by two or more light emitted diode light bars in series, said two or more series light bars have two support points; transparent lamp base, equipped with a table-board without substantially apparent raised structure, said transparent lamp base and said bulb shell formed a receiving space; and two or more support bars, extended upwardly from said transparent lamp base and connected said support points respectively. In some embodiments, wherein said support bar is made up of metallic material, and substantially kept linear extending.

DETAILED DESCRIPTION OF THE PREFERRED EMBODIMENTS

Figure 1:
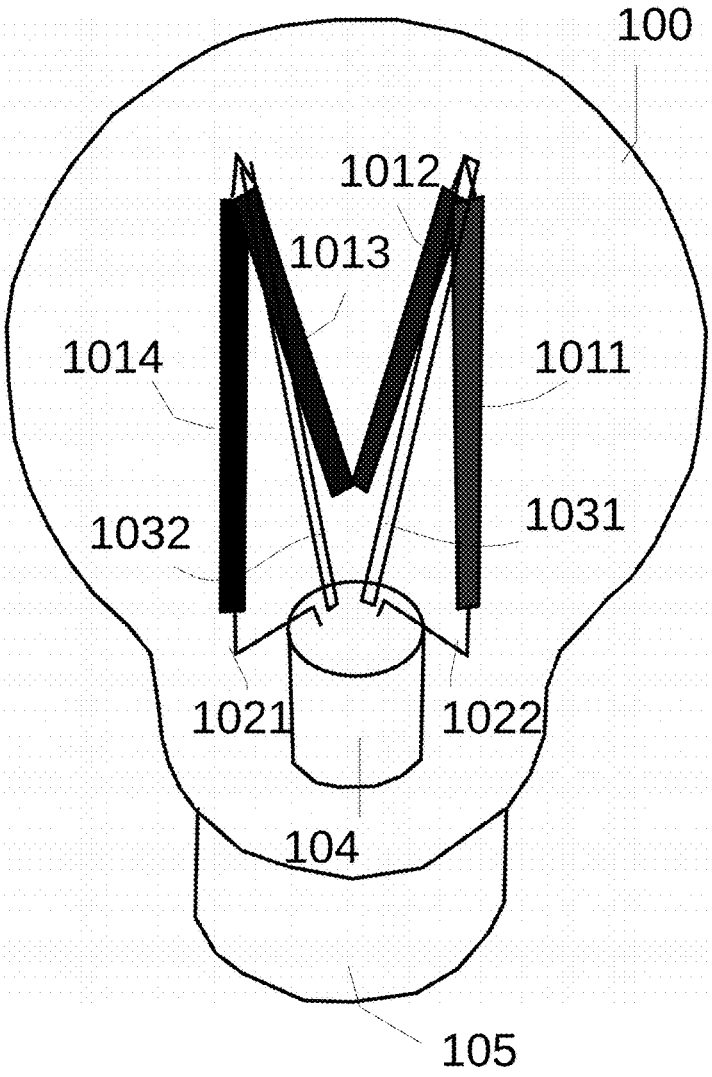
FIG. 1 illustrates a schematic stereogram of a lighting device according to an embodiment of the present disclosure.
Figure 2:
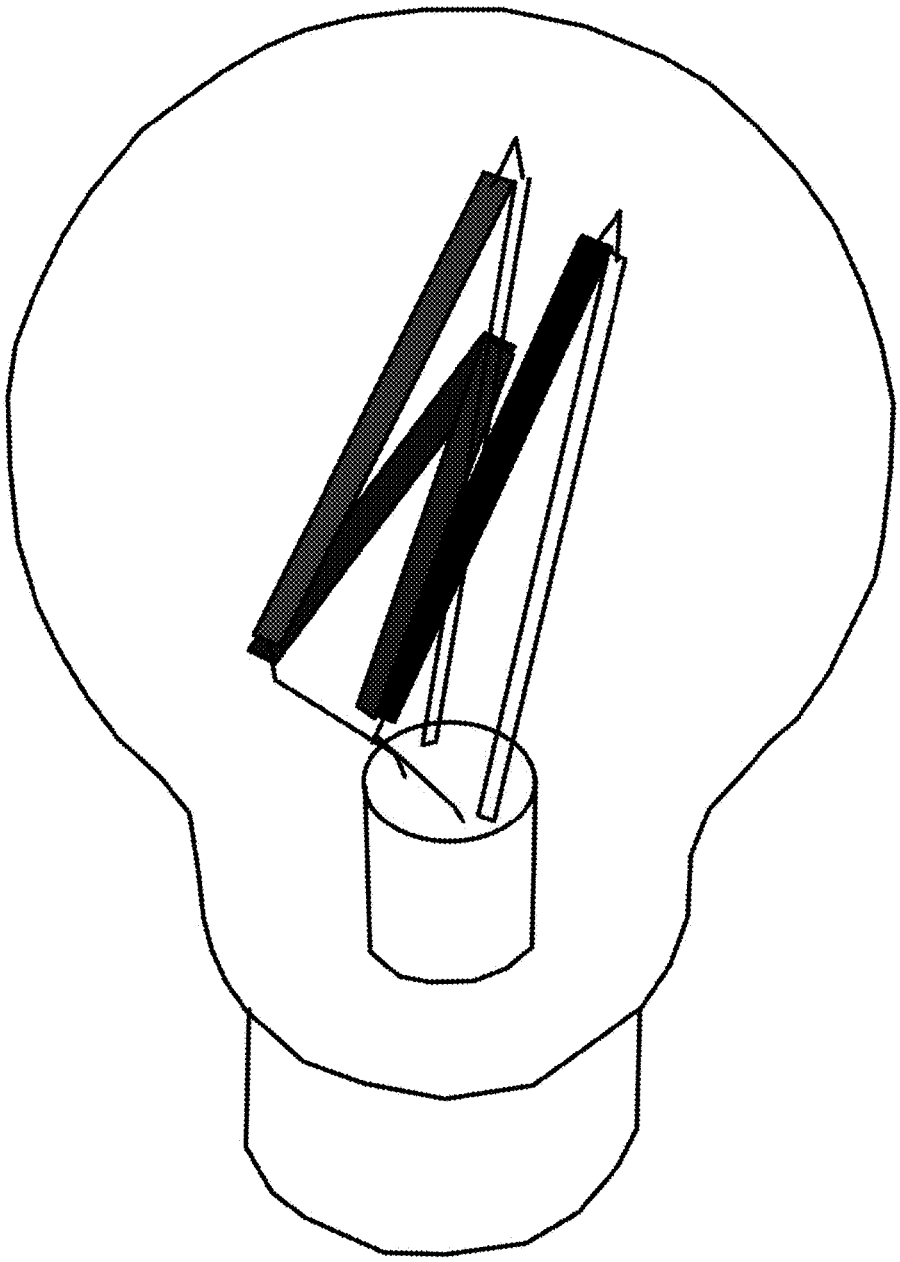
FIG. 2 illustrates another schematic stereogram of FIG. 1 at another angle.

Please refer to FIG. 1 and FIG. 2. FIG. 1 illustrates a schematic stereogram of a lighting device according to an embodiment of the present disclosure. FIG. 2 illustrates another schematic stereogram of FIG. 1 at another angle.

The first embodiment of the instant disclosure provides a lighting device, the lighting device includes a translucent shell 100, a bottom base 105, a lamp base 104, a light bar module and a metal support bar 1031,1032. The translucent shell 100 may be fully translucent, or partially translucent. For example, the translucent shell 100 may be made of a translucent material such as glass, plastic material, etc., and may be further atomized or patterned on the surface in whole or in part.

The bottom base 105 connected with the translucent shell 100 to form a receiving space together. For example, when the lighting device is a light bulb, the bottom base 105 is a bulb head, and two conductive terminals are provided in side and bottom for connecting to an external power source. In another embodiment, a removable or rechargeable battery is provided in the inner space. If the external power supply is directly connected, a driving circuit may be provided for converting the general indoor power to a voltage suitable for driving the light emitted diode.

The lamp base 104 set on said bottom base 105 with a table-board, and said lamp base 104 is arranged in said receiving space. The light bar module is formed by connecting two or more light bars 1011,1012,1013,1014 in series, said two or more light bars have two supporting points. For example, there is a support point between the light bars 1011 and 1012, another support point between the light bars 1013 and 1014. And said light bar module has two electrical connection points. Taking light emitted diode bulb as an example, a number of light emitted diode chips can be packaged in series into a light bar. And then the light bars can be further connected in series or in parallel. For a chip of a light emitted diode, a positive voltage terminal and a negative voltage terminal are required. They can be connected to the voltage supply point of the drive circuit to drive the chip of light emitted diode to emit light.

Two or more metal support bars 1031,1032 extend upwardly from said table-board of said lamp base and connect to said one support point, respectively. The upward direction mentioned here refers to a variety of directions extending away from the lamp base and towards the translucent shell.

In addition, two metal conducting bars 1021,1022 extend upwardly from the lamp base 104 and connect to two electrical connection points of the light bar module, respectively. Wherein said metal support bar 1031,1032, said light bar 1011,1012,1013,1014 and said metal conducting bar 1021,1022 form two substantial triangular frame structures. The triangular frame structure mentioned above does not need to be a geometrical triangle. As long as the whole structure similar to a triangle, substantially, all can belong to said substantial triangle frame structure. And, said metal support bar, said light bar and said metal conducting bar may respectively play a part or all sides of the triangular frame structure under different designs. Some available combination ways will be illustrated with some additional graphics as follows. In further designs, said substantial triangular frame structure is compose of polygons. The polygon includes three long sides, forming a triangular-like shape substantially. Needless to say, the present invention is not limited to these examples, as long as the combination ways can achieve a substantially similar effect, all should be considered to be within the scope of the present invention.

Figure 4A:
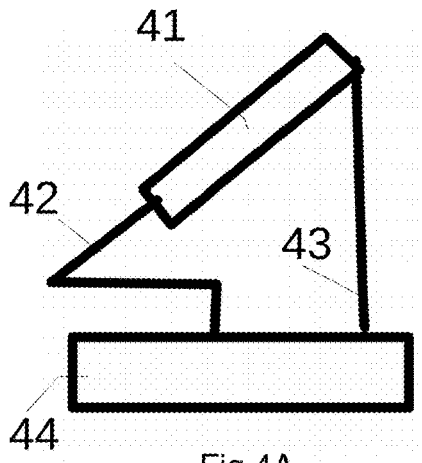
FIG. 4A illustrates a schematic diagram among metal support bar, metal conducting bar, light bar and lamp base according to an embodiment of the present disclosure.
Figure 4B:
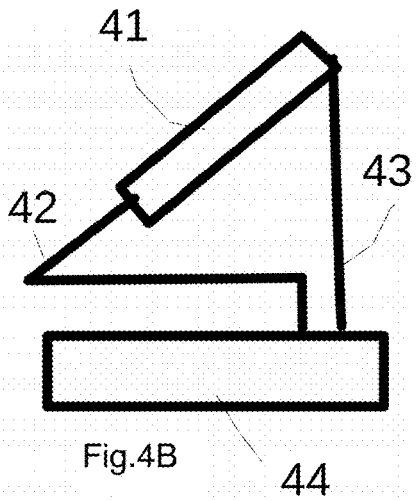
FIG. 4B illustrates a schematic diagram among metal support bar, metal conducting bar, light bar and lamp base according to another embodiment of the present disclosure.
Figure 4C:
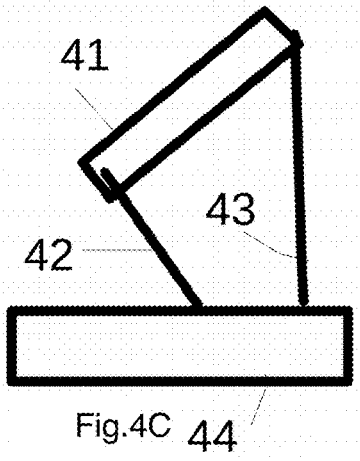
FIG. 4C illustrates a schematic diagram among metal support bar, metal conducting bar, light bar and lamp base according to another embodiment of the present disclosure.
Figure 4D:
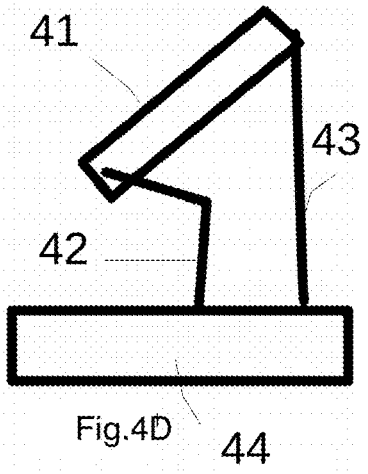
FIG. 4D illustrates a schematic diagram among metal support bar, metal conducting bar, light bar and lamp base according to another embodiment of the present disclosure.
Figure 4E:
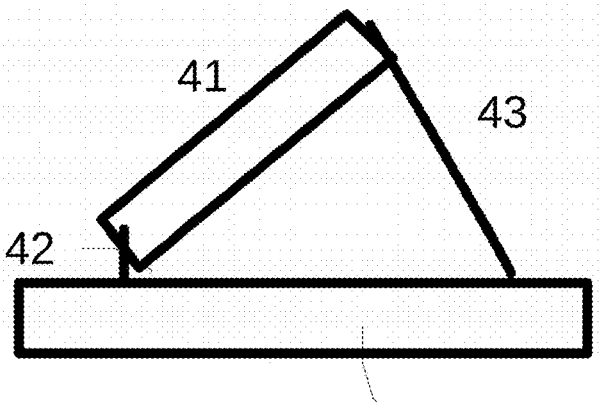
FIG. 4E illustrates a schematic diagram among metal support bar, metal conducting bar, light bar and lamp base according to another embodiment of the present disclosure.

Hereinafter please refer to FIGS. 4A, 4B, 4C, 4D, 4E, 5A, 5B, 6A, 6B, 6C, 6D, 7A and 7B. FIG. 4A illustrates a schematic diagram among metal support bar 43, metal conducting bar 42, light bar 41 and lamp base 44 according to an embodiment of the present disclosure. FIG. 4B illustrates a schematic diagram among metal support bar 43, metal conducting bar 42, light bar 41 and lamp base 44 according to another embodiment of the present disclosure. FIG. 4C illustrates a schematic diagram among metal support bar 43, metal conducting bar 42, light bar 41 and lamp base 44 according to another embodiment of the present disclosure. FIG. 4D illustrates a schematic diagram among metal support bar 43, metal conducting bar 42, light bar 41 and lamp base 44 according to another embodiment of the present disclosure. FIG. 4E illustrates a schematic diagram among metal support bar 43, metal conducting bar 42, light bar 41 and lamp base 44 according to another embodiment of the present disclosure. From these figures we can see, the substantial triangular frame structure mentioned above does not need to be a strict geometrical triangle, even the side with a certain degree of curvature also can belong to said substantial triangle frame structure.

Figure 5A:
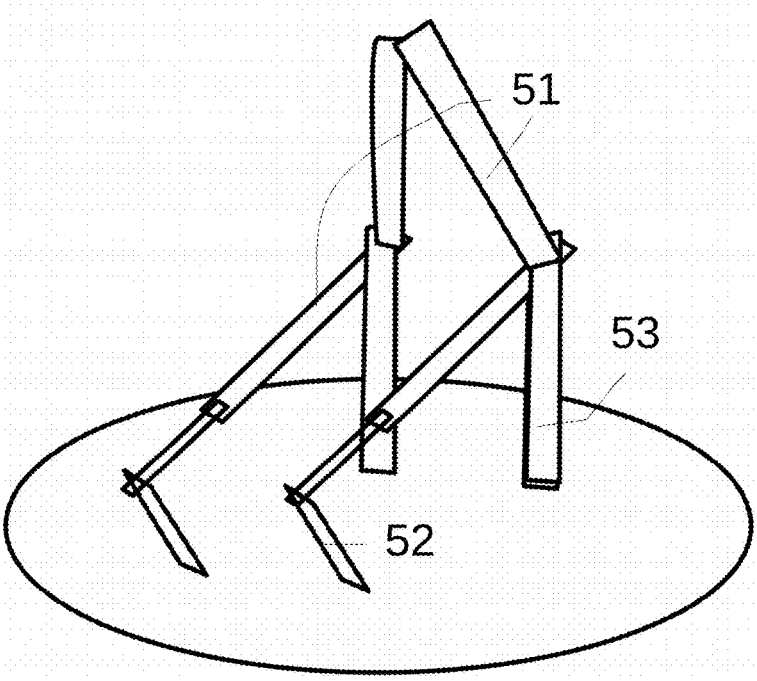
FIG. 5A illustrates a schematic stereogram of the relationship among metal support bar, metal conducting bar, light bar and lamp base according to an embodiment of the present disclosure.
Figure 5B:
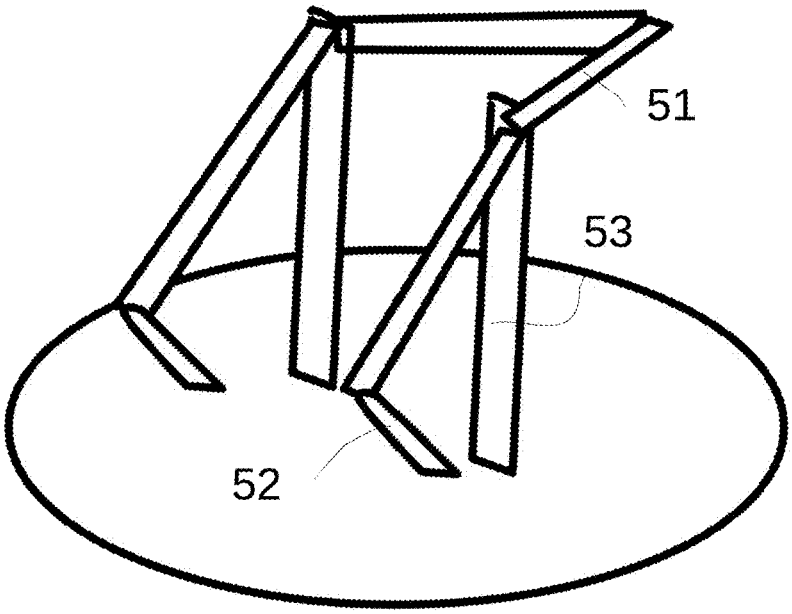
FIG. 5B illustrates a schematic stereogram of the relationship among metal support bar, metal conducting bar, light bar and lamp base according to another embodiment of the present disclosure.

FIG. 5A illustrates a schematic stereogram of the relationship among metal support bar 53, metal conducting bar 52, light bar 51 and lamp base according to an embodiment of the present disclosure. FIG. 5B illustrates a schematic stereogram of the relationship among metal support bar 53, metal conducting bar 52, light bar 51 and lamp base according to another embodiment of the present disclosure. From the two figures we can see, the light bars may extend at different angles.

Figure 6A:
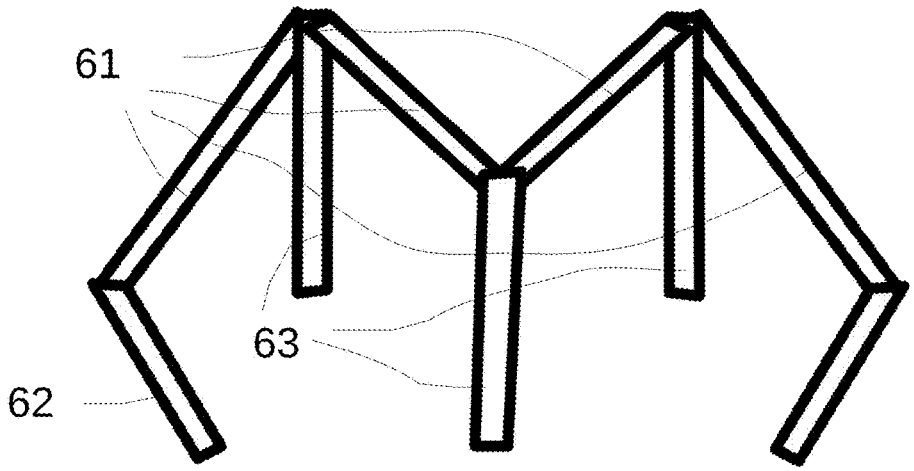
FIG. 6A illustrates a schematic stereogram of the relationship among metal support bar, metal conducting bar and light bar according to an embodiment of the present disclosure.
Figure 6B:
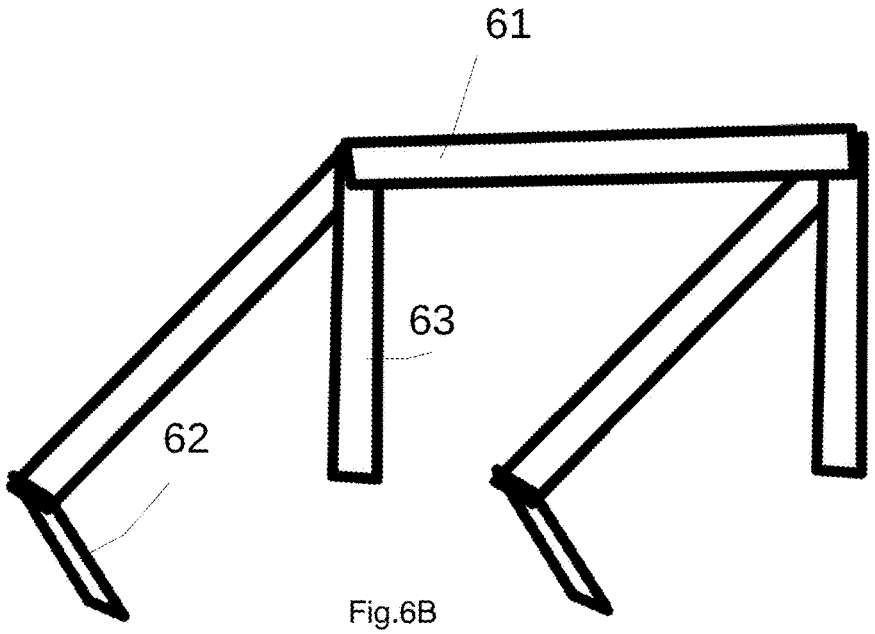
FIG. 6B illustrates a schematic stereogram of the relationship among metal support bar, metal conducting bar and light bar according to another embodiment of the present disclosure.
Figure 6C:
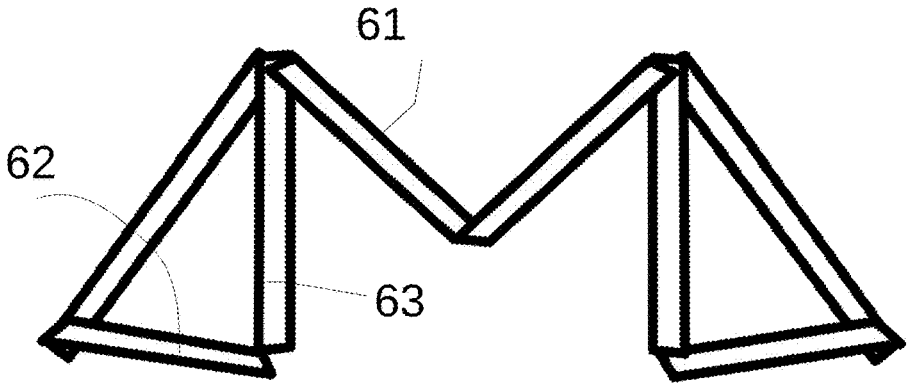
FIG. 6C illustrates a schematic stereogram of the relationship among metal support bar, metal conducting bar and light bar according to another embodiment of the present disclosure.
Figure 6D:
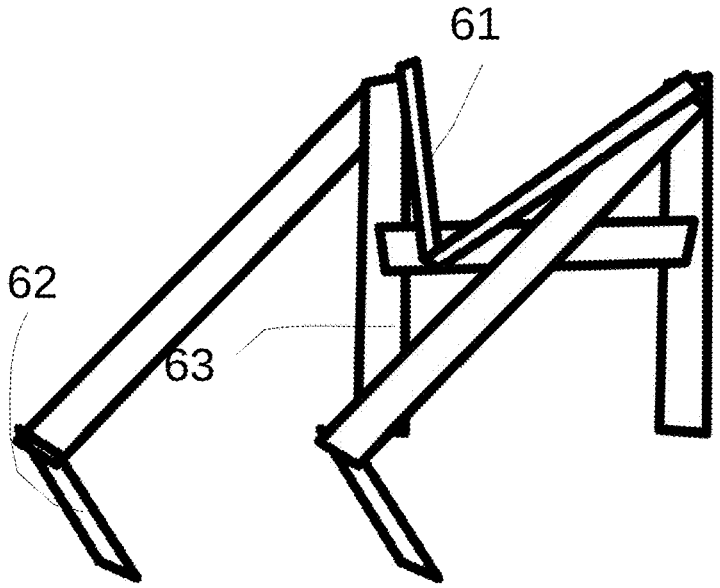
FIG. 6D illustrates a schematic stereogram of the relationship among metal support bar, metal conducting bar and light bar according to another embodiment of the present disclosure.

FIG. 6A illustrates a schematic stereogram of the relationship among metal support bar 63, metal conducting bar 62 and light bar 61 according to an embodiment of the present disclosure. FIG. 6B illustrates a schematic stereogram of the relationship among metal support bar 63, metal conducting bar 62 and light bar 61 according to another embodiment of the present disclosure. FIG. 6C illustrates a schematic stereogram of the relationship among metal support bar 63, metal conducting bar 62 and light bar 61 according to another embodiment of the present disclosure. FIG. 6D illustrates a schematic stereogram of the relationship among metal support bar 63, metal conducting bar 62 and light bar 61 according to another embodiment of the present disclosure.

Figure 7A:
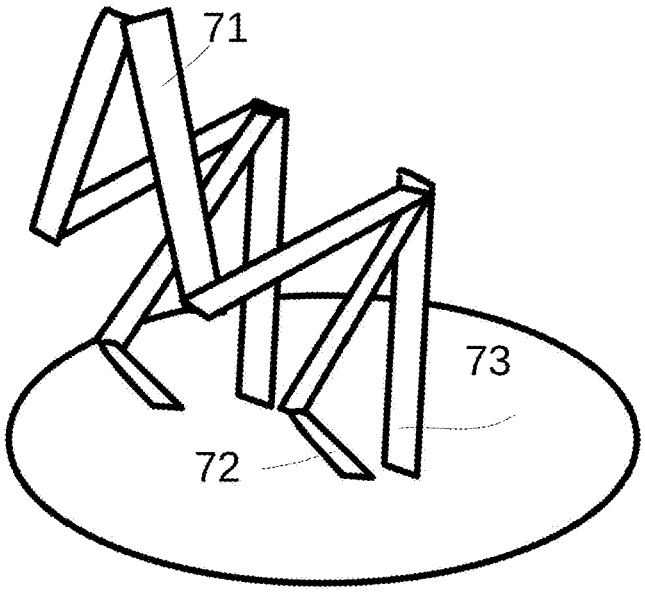
FIG. 7A illustrates a schematic stereogram of the relationship among metal support bar, metal conducting bar and light bar according to another embodiment of the present disclosure.
Figure 7B:
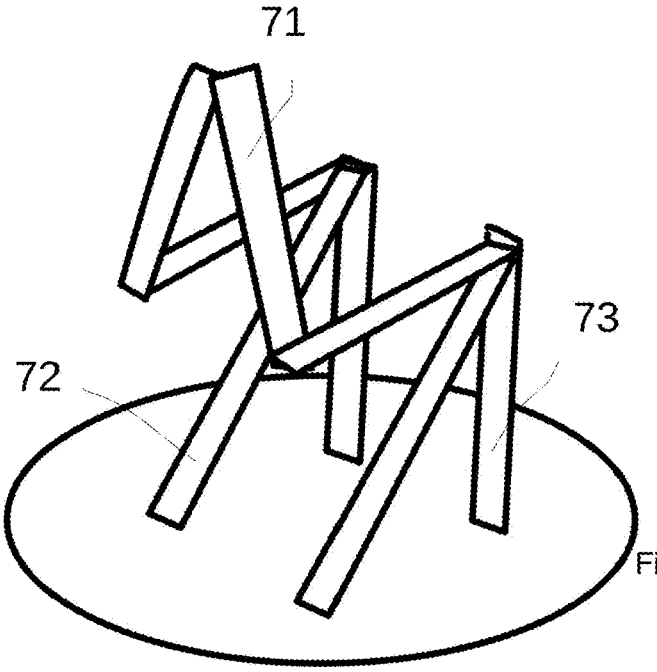
FIG. 7B illustrates a schematic stereogram of the relationship among metal support bar, metal conducting bar and light bar according to another embodiment of the present disclosure.

FIG. 7A illustrates a schematic stereogram of the relationship among metal support bar 73, metal conducting bar 72 and light bar 71 according to an embodiment of the present disclosure. FIG. 7B illustrates a schematic stereogram of the relationship among metal support bar 73, metal conducting bar 72 and light bar 71 according to another embodiment of the present disclosure.

Figure 8:
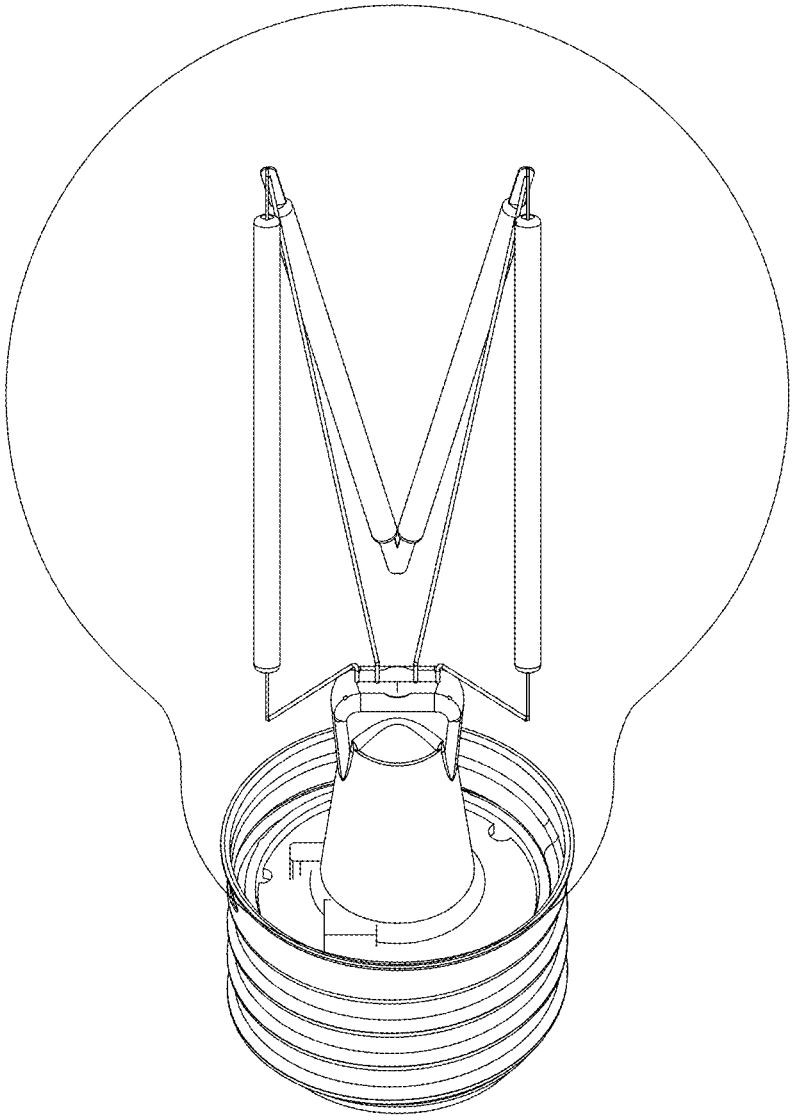
FIG. 8 illustrates a light bulb device according to an embodiment of the present disclosure.

In addition, FIG. 8 illustrates a light bulb device according to an embodiment of the present disclosure.

In a design, the lamp base also has a certain degree of transparency. For example, the lamp base may be made of glass. The translucent shell also could be made of glass. When both the lamp base and the translucent shell are made of glass, it is possible to carry out the blow molding of the glass by using a conventional bulb manufacturing process, and to perform various predetermined shapes such as bulb type, water drop type, candle type, flat-head type, or all kinds of predetermined shapes.

Figure 3:
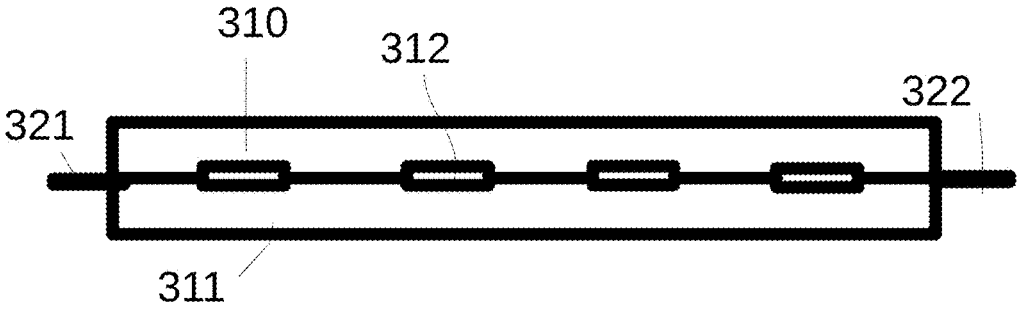
FIG. 3 illustrates a light bar with a light emitted diode chip according to an embodiment of the present disclosure.

FIG. 3 illustrates a light bar with a light emitted diode chip according to an embodiment of the present disclosure. A plurality of light emitted diode chips 312 are packaged in series by two translucent materials 310, 311, and have conductive terminals 321, 322 at both ends.

A pipe may be left in the blown manufacturing process, it can be used to fill the cooling gas. The method of operation in practice includes placing the lamp in a vacuum environment and then pouring various cooling gases. In some embodiments, when the power of the light emitted diode is small, the cooling gas may not be completely filled but maintain the proportion of air at, for example, 3% or more. It not only can produce a certain adjustment to the light emitting effect, but also reduce the manufacturing process's requirements and cost.

In some embodiments, said table-board of said lamp base substantially kept flat, no raised configuration. This does not mean that a certain flat is necessary, but no substantially apparent raised structure. The support of light bar is mainly achieved by the metal support bar.

In some embodiments, the height of said table-board of said lamp base is lower than the bottom position of said light bar in said light bar module.

In some embodiments, said metal support bar connects and supports said light bar module through a fastening structure at said support point. For example, there are a certain bending, buckles, springs, hooks, grooves or bumps at the support point of the metal support bar or light bar, therefor the complicated welding process can be omitted. Or even the welding process is needed, it can further enhance the stability of the structure.

In some embodiments, the appearance characteristics of said metal support bar are substantially same as said metal conducting bar.

In some embodiments, said metal support bar and said light bar module constitute an assembly unit and form a predetermined shape, and then mounted to said lamp base in the manner of said assembly unit. In this way, the complexity of assembling can be reduced to a certain extent.

In some embodiments, the rigidity of said metal conducting bar can maintain it at a fixed shape. In some embodiments, said metal support bar has a groove paralleled to the direction of said metal support bar extending from said lamp base. For example, said metal support bar is elongated and folded at a certain angle along the direction of extension to achieve greater rigidity with less material. In some embodiments, said metal support bar is nickel plated.

Another embodiment of the instant disclosure provides a lighting device, comprising light bulb shell; light bulb module, composed by two or more light emitted diode light bars in series, said two or more series light bars have two support points; transparent lamp base, equipped with a table-board without substantially apparent raised structure, said transparent lamp base and said bulb shell formed a receiving space; and two or more support bars, extended upwardly from said transparent lamp base and connected said support points respectively. In some embodiments, wherein said support bar is made up of metallic material, and substantially kept linear extending.

In addition to the above examples, as long as the other modifications and changes are within the concept of the present invention, all should and can belong to the scope of the present invention.

What is claimed is:

1. A lighting device, comprising:

a translucent shell;

a bottom base, connected with said translucent shell to form a receiving space together;

a lamp base, set on said bottom base, with a table-board, and said lamp base is arranged in said receiving space;

a light bar module, formed by connecting four light bars in series, wherein there are three connecting points respectively located between two adjacent light bars of the four light bars, there are two of the connecting points used as two supporting points, and said light bar module has two electrical connection points at two ends of said light module;

two or more metal support bars, extended upwardly from said table-board of said lamp base, and each metal support bar connected to one of the support points respectively; and two metal conducting bars, extended upwardly from said lamp base and connected to said two electrical connection points of said light bar module respectively wherein two middle light bars of the four light bars form a protruding triangle in a plane not co-plane with the other two light bars of the four light bars, and the connecting point between the two middle light bars is not connected to any supporting structure.

2. The lighting device of claim 1, wherein said lamp base has a certain degree of transparency.

3. The lighting device of claim 1, wherein said lamp base is made of glass.

4. The lighting device of claim 1, wherein said table-board of said lamp base substantially kept flat, no raised configuration.

5. The lighting device of claim 1, wherein said substantial triangular frame structure is composed of polygon, and said polygon is a substantially triangular-like shape formed by three long sides.

6. The lighting device of claim 1, wherein said translucent shell is a bulb shell, said bottom base is a bulb head, and said lamp head has two conductive terminals for connecting to an external power source.

7. The lighting device of claim 1, wherein the height of said table-board of said lamp base is lower than the bottom position of said light bar in said light bar module.

8. The lighting device of claim 1, further comprising a driving circuit, set in said bottom base, used for converting the external power source into electric power suitable for driving the light bar module to emit light.

9. The lighting device of claim 1, wherein said receiving space provided for filling with cooling gas.

10. The lighting device of claim 1, wherein said metal support bar connected and supported said light bar module through a fastening structure at said support point.

11. The lighting device of claim 1, wherein the appearance characteristics of said metal support bar are substantially same as said metal conducting bar.

12. The lighting device of claim 1, wherein said metal support bar and said light bar module constituted an assembly unit and formed a predetermined shape, and then mounted to the translucent base in the manner of said assembly unit.

13. The lighting device of claim 1, wherein said light bar of said light bar module including two or more light emitted diode chips, and is packaged with translucent material.

14. The lighting device of claim 1, wherein said receiving space is filled with cooling gas and air, and the molecule proportion of the air is more than 3%.

15. The lighting device of claim 1, wherein said metal conducting bar has a rigidity capable of maintaining it at a fixed shape.

16. The lighting device of claim 1, wherein said metal support bar has a groove paralleled to the direction of said metal support bar extending from said lamp base.

17. The lighting device of claim 1, wherein said metal support bar is nickel plated.

* * * * *